US006527198B1

(12) United States Patent
Stoecklein

(10) Patent No.: US 6,527,198 B1
(45) Date of Patent: Mar. 4, 2003

(54) FUEL INJECTION VALVE FOR INTERNAL COMBUSTION ENGINES

(75) Inventor: Wolfgang Stoecklein, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/869,242

(22) PCT Filed: Oct. 11, 2000

(86) PCT No.: PCT/DE00/03565

§ 371 (c)(1),
(2), (4) Date: Sep. 6, 2001

(87) PCT Pub. No.: WO01/31191

PCT Pub. Date: May 3, 2001

(51) Int. Cl.[7] ..... B05B 3/04

(52) U.S. Cl. ..... 239/102.2; 239/88; 239/90; 239/95; 239/124; 239/533.2; 239/585.1

(58) Field of Search ..... 239/102.2, 124, 239/88, 90, 91, 93, 95, 96, 533.2, 585.1

(56) References Cited

U.S. PATENT DOCUMENTS

| | | | | | |
|---|---|---|---|---|---|
| 3,680,782 | A | * | 8/1972 | Monpetit et al. | 239/96 |
| 4,899,935 | A | * | 2/1990 | Yoshida et al. | 239/91 |
| 5,806,766 | A | * | 9/1998 | Krueger et al. | 239/124 |
| 5,875,764 | A | * | 3/1999 | Kappel et al. | 123/446 |
| 6,142,443 | A | * | 11/2000 | Potschin et al. | 239/102.2 |
| 6,168,096 | B1 | * | 1/2001 | Potschin et al. | 239/124 |

FOREIGN PATENT DOCUMENTS

| | | | | |
|---|---|---|---|---|
| DE | 19519192 C1 | * | 6/1996 | F02M/47/02 |
| DE | 19752851 C1 | * | 12/1998 | F15B/13/044 |
| DE | 198 13 983 A1 | | 9/1999 | |

* cited by examiner

*Primary Examiner*—Robin O. Evans
(74) *Attorney, Agent, or Firm*—Michael J. Striker

(57) ABSTRACT

The fuel injection valve (16) has an injection valve member (24), by which at least one injection opening (26) is controlled.

Figure 1:
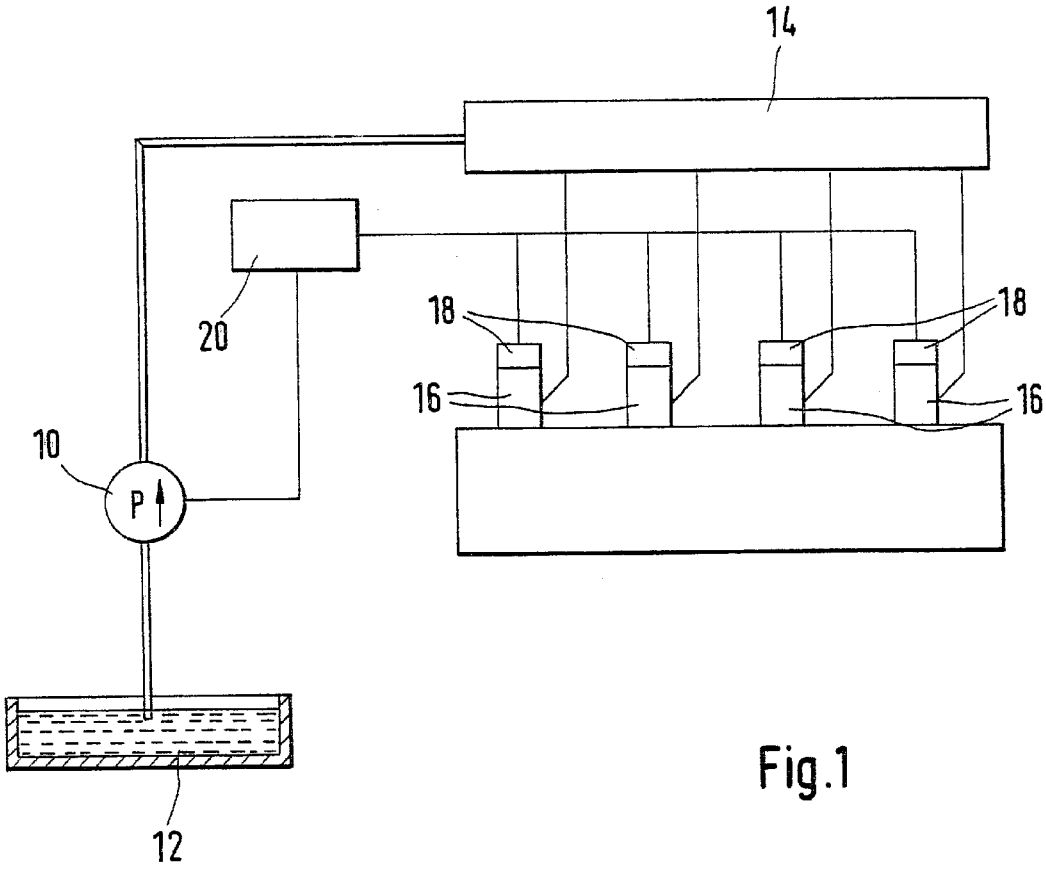

The motion of the injection valve member (24) is varied by a control valve (18) that has a control valve member (54) by which the pressure in a control pressure chamber (50) is controlled in that the control valve member controls a relief chamber (46) in a closing piston (42) that defines the control pressure chamber (50) and that by means of the pressure prevailing in the control pressure chamber (50) urges the injection valve member (24) in its closing direction. The control valve member (54) is displaceable via a hydraulic boost by a piezoelectric actuator (78), as a result of which the piezoelectric actuator opens or closes the relief chamber (46). The control valve member (54) cooperates as a valve seat with the orifice (47) of the relief chamber (46) at the closing piston (42), and its cross-sectional area in the control pressure chamber (50) is at least approximately equal to the cross-sectional area of the orifice (47) of the relief chamber (46), so that because of the pressure in the control pressure chamber (50), no force is exerted on the control valve member (54), and only a slight force is required to displace it.

5 Claims, 2 Drawing Sheets

FUEL INJECTION VALVE FOR INTERNAL COMBUSTION ENGINES

PRIOR ART

The invention is based on a fuel injection valve for internal combustion engines as generically defined by the preamble to claim 1.

One such fuel injection valve is known from German patent disclosure DE 198 13 983 A1. This fuel injection valve is a component part of a reservoir-type fuel injection system and has an injection valve member by which at least one injection opening is controlled and which has a pressure shoulder that defines a pressure chamber. Fuel under pressure can be delivered to the pressure chamber from a high-pressure fuel source via a pressure line, by which fuel the injection valve member can be lifted from a valve seat counter to a closing force to open the at least one injection opening. The motion of the injection valve member is varied by a control valve that has a piezoelectric actuator-actuated control valve member, which controls a pressure, prevailing in a control pressure chamber that communicates with a pressure source, that urges the injection valve member in its closing direction. By means of the control valve member, the control pressure chamber can be made to communicate with a relief chamber, and as a result the pressure in the control pressure chamber drops, and the injection valve member can be moved in the opening direction. The motion of the control valve member by means of the piezoelectric actuator must take place counter to the pressure prevailing in the control pressure chamber, so that moving the control valve member entails a major expenditure of force.

ADVANTAGES OF THE INVENTION

The fuel injection valve of the invention as defined by the characteristics of claim 1 has the advantage over the prior art that the motion of the control valve member for connecting the control pressure chamber to the relief chamber need not take place counter to the pressure in the control pressure chamber, and thus only slight force is required to move the control valve member. This makes it possible to use a piezoelectric actuator of slight dimensions, and thus the structural size and the weight of the control valve can be kept small and low, respectively. Furthermore, by means of the control valve member, the opening stroke of the injection valve member can be limited in an infinitely graduated way.

Advantageous features and refinements of the fuel injection valve of the invention are defined by the dependent claims. By means of the embodiment defined by claim 2, secure closing of the conduit at the closing piston by the control valve member is achieved, if the piezoelectric actuator is not activated. By means of the spring provided in accordance with claim 3, the force the piezoelectric actuator must exert to move the control valve member counter to the restoring spring is reduced.

DRAWING

One exemplary embodiment of the invention is shown in the drawing and described in further detail below. FIG. 1 shows a reservoir-type fuel injection system in schematic fashion, and FIG. 2 shows a fuel injection valve of the reservoir-type fuel injection system in a longitudinal section.

DESCRIPTION OF THE EXEMPLARY EMBODIMENT

A reservoir-type fuel injection system schematically shown in FIG. 1 has a high-pressure pump 10, by which fuel is pumped at high pressure from a tank 12 into a reservoir 14. The reservoir 14 is embodied as a so-called rail, from which lines lead away to fuel injection valves 16 disposed in an internal combustion engine. Each fuel injection valve 16 has one control valve 18, by which the opening and closing of the fuel injection valve 16 is controlled. The reservoir-type fuel injection system furthermore has a control unit 20, which is supplied with signals about various operating parameters of the engine and by which, as a function of these signals, the control valves 18 of the fuel injection valves 16 are triggered to open or close the fuel injection valves.

Figure 2:
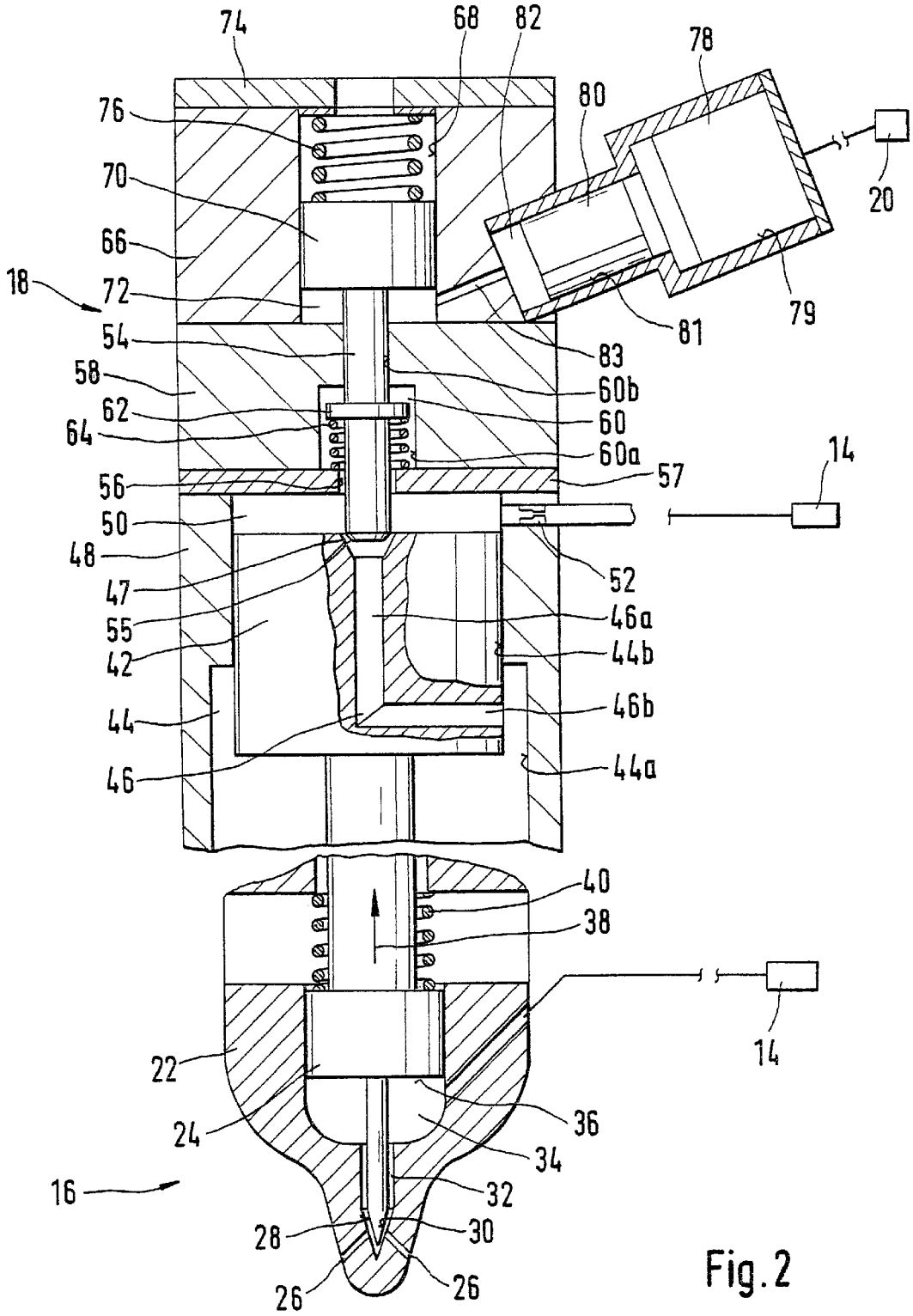

In FIG. 2, one fuel injection valve 16 is shown with its associated control valve 18. The fuel injection valve 16 has a valve body 22, in which an injection valve member 24 is guided axially displaceably. The valve body 22, in its end region toward the engine combustion chamber, has at least one and preferably a plurality of injection openings 26. The injection valve member 24, in its end region toward the combustion chamber, has a sealing face 28, for instance of approximately conical shape, that cooperates with a valve seat 30, embodied in the valve body 22, from which the injection openings 26 lead away. An annular chamber 32 surrounding the injection valve member 24 is embodied in the valve body 22 and communicates with a pressure chamber 34, which in turn communicates with the reservoir 14, so that the pressure generated by the high-pressure pump 10 prevails in the pressure chamber 34. The injection valve member 24 has a pressure shoulder 36, disposed in the pressure chamber 34, and by way of this shoulder the pressure prevailing in the pressure chamber 34 exerts a force on the injection valve member 24 in the opening direction 38 thereof. The injection valve member 24 is engaged by a prestressed closing spring 40, by which the injection valve member 24 is urged in the closing direction, counter to the force prevailing in the pressure chamber 34 and acting on the injection valve member in the opening direction 38. By means of the pressure prevailing in the pressure chamber 34, the injection valve member 24 is movable in the opening direction 38 counter to the force of the closing spring 40 and thereby uncovers the injection openings 26, through which fuel is injected into the engine combustion chamber. To terminate the injection, the injection valve member 24 is pressed in the closing direction, being pressed with its sealing face 28 into the valve seat 30 at the valve body 22, so that the injection openings 26 are closed.

A closing piston 42 that is part of the control valve 18 is disposed In the region of the end of the injection valve member 24 remote from the combustion chamber. The closing piston 42 can be embodied integrally with the injection valve member 24, or it can be a separate part. The closing piston 42 is disposed at least approximately coaxially to the injection valve member 24 and is guided axially displaceably in a housing part 48 of the control valve 18. A conduit 46 is embodied in the closing piston 40 and has one portion 46*a* that originates at the face end of the closing piston 42 remote from the injection valve member 24 and extending approximately coaxially to the longitudinal axis of the closing piston 42, and another portion 46*b* adjoining the first portion and extending approximately perpendicular to the longitudinal axis of the closing piston 42, which latter portion discharges at the jacket of the closing piston 42, near the end thereof toward the injection valve member 24. In the region of the orifice of the portion 46*b* of the conduit 46, the closing piston 42 is disposed in a portion 44*a* of enlarged diameter in the bore 44, while the region of the closing piston 42 remote from the injection valve member 24 is guided tightly in a smaller-diameter portion 44*b* of the bore 44. Because of the enlarged-diameter portion 44*a* of the bore 44, there is an annular chamber between this bore and the closing piston 42, with the orifice of the conduit portion 44*b*, that communicates with a relief chamber, which can for example be the tank 12.

In the portion 44*b* of the bore 44, the closing piston 42 defines a control pressure chamber 50, which communicates via a throttle 52 with the reservoir 14. The end of a control valve member 54 protrudes into the control pressure chamber 50, at least approximately coaxially to the closing piston 42 and to the portion 46*a* of its conduit 46. At the end of the control valve member 54, a sealing face 55 is formed, which can for instance be conical and which cooperates as a valve seat with the correspondingly also-conical orifice 47 of the conduit portion 46*a* of the closing piston 42. By means of the sealing face 55 of the control valve member 54, the orifice 47 of the conduit portion 46*a* at the closing piston 42 can be opened and closed. When the orifice 47 of the conduit portion 46*a* at the closing piston 42 is closed by the control valve member 54, then the same pressure prevails in the control pressure chamber 50 as in the reservoir 14, and the injection valve member 24 is kept in its closing position. When the orifice 47 of the conduit portion 46*a* at the closing piston 42 is opened by the control valve member 54, then fuel can flow out of the control pressure chamber 50 through the conduit 46 in the closing piston 42, and in the control pressure chamber 50 a lesser pressure prevails than in the reservoir 14, so that by the pressure acting on its pressure shoulder 36, the injection valve member 24 can be opened, counter to the force of the closing spring 40 and to the force exerted on the end face of the closing piston 42, by the pressure prevailing in the control pressure chamber 50.

The control valve member 54 protrudes with its end through an opening 56 in a shim 57 of the control valve housing. The shim 57 is adjoined by a further housing part 58 of the control valve housing that has a stepped bore 60 with one portion 60*a* of larger diameter, embodied toward the shim 57, and another portion 60*b* of smaller diameter embodied adjoining the first. In its region disposed in the bore portion 60*a*, the control valve member 54 has an annular collar 62 of enlarged diameter, compared to the diameter of the end of the control valve member 54 that protrudes into the control pressure chamber 50. Between the shim 57 and the annular collar 62 of the control valve member 54, there is a prestressed spring 64, by means the control valve member 54 is pulled away from the closing piston 42.

Adjoining the annular collar 62, the control valve member 54 again has approximately the same diameter as on its end protruding into the control pressure chamber 50, and it passes, guided tightly, through the bore portion 60*b*. The housing part 58 of the control valve 18 is adjoined by a further housing part 66, which has a bore 68, at least approximately coaxial to the control valve member 54, of larger diameter than the bore portion 60*b*. In the region of the control valve member 54 disposed in the bore 58, there is a control piston 70 of enlarged diameter, compared to the region that passes through the bore portion 60*b*. The control piston 70 defines a work chamber 72 in the bore 68 to the housing part 58. The housing part 66 is adjoined by a disk-shaped housing part 74, and between it and the face end of the control piston 70 remote from the work chamber 72, there is a prestressed restoring spring 72.

The work chamber 72 communicates with a piezoelectric actuator 78 via a hydraulic boost. The piezoelectric actuator 78 is triggered by the control unit 20 and varies its length as a function of an electrical voltage applied to it. The piezoelectric actuator 78 is disposed in a cylinder 79 and upon its change in length it effects a compression or depressurization of a hydraulic volume disposed in the cylinder. The hydraulic boosting is achieved in that the hydraulic volume varied by the piezoelectric actuator 78 acts upon a piston 80 of reduced diameter, compared to the piezoelectric actuator 78, and this piston, upon a change in length of the piezoelectric actuator 78, executes a stroke that is lengthened by the ratio of the diameter of the piezoelectric actuator 78 to the diameter of the piston 80. The piston 80 is disposed at least approximately coaxially to the piezoelectric actuator 78 and is guided displaceably in a cylinder 81 of corresponding diameter. The piston 80 defines a work chamber 82 that communicates with the work chamber 72 via a smaller-diameter conduit 83 in the housing part 66. Both the piezoelectric actuator 78 and the piston 80 can be disposed arbitrarily on the circumference of the housing part 66 of the control valve 18 and can be inclined with their longitudinal axes approximately perpendicularly to the longitudinal axis of the control valve 18 or, as shown in FIG. 2, arbitrarily to the longitudinal axis of the control valve.

By the spring 64, the control valve member 54 is pulled away from the closing piston 42, while the control valve member 54 is pressed toward the closing piston 42 by the restoring spring 76. The prestressing of the restoring spring 76 is greater than the prestressing of the spring 64, SO that at a slight pressure in the work chamber 72, the control valve member 52 is pressed by the restoring spring 76 against the closing piston 42 and keeps the conduit 46 closed; in turn, by the pressure in the control pressure chamber 50 acting on the closing piston 42, the injection valve member 24 is kept in its closing position.

When the piezoelectric actuator 78 is triggered by the control unit 20, its length increases, and by means of the piston 80, a hydraulic volume is positively displaced out of the work chamber via the conduit 83 into the work chamber 72, where the pressure rises until the force exerted by this pressure on the control piston 70 plus the force of the spring 64 is capable of overcoming the prestressing of the restoring spring 76, and the control valve member 54 is moved away from the closing piston 42.

In the process, the orifice 47 of the conduit 46 in the closing piston 42 is opened by the control valve member 54, so that between the sealing face 55 of the control valve member 54 and the orifice 47 of the conduit 46 a gap is created, through which fuel can flow out of the control pressure chamber 50 through the conduit 46. The pressure in the control pressure chamber 50 drops as a result, so that by the pressure exerted in the pressure chamber 34 on its pressure shoulder 36, the injection valve member 24 is moved in the opening direction 38, counter to the reduced pressure in the control pressure chamber 50 and counter to the force of the closing spring 40, and uncovers the injection openings 26. The closing piston 42 moves together with the injection valve member 24 in the opening direction 38 of the injection valve member, and as a result the gap between the sealing face 55 of the control valve member 54 and the orifice 47 of the conduit 46 becomes smaller again. The result is an increased throttling action at the gap between the sealing face 55 of the control valve member 54 and the orifice 47 of the conduit 46, and as a result the pressure in the control pressure chamber 50 rises again, since less fuel can flow out of the control pressure chamber 50. The closing piston 42 thus follows the position of the control valve member 54, and the gap between the sealing face 55 of the control valve member 54 and the orifice 47 of the conduit 46 at the face end of the closing piston 42 is adjusted such that the system of the control valve 18 is in equilibrium. As already noted above, the closing piston 42 can be embodied either integrally with the injection valve member 24 or as a separate component that is connected to the injection valve member 24. A coupling between the closing piston 42 and the injection valve member 24 is also effected by the pressure prevailing in the control pressure chamber 50, which presses the closing piston 42 against the injection valve member 24. If the gap between the sealing face 55 of the control valve member 54 and the orifice 47 of the conduit 46 were too small, then the pressure in the control pressure chamber 50 would rise, and the closing piston 42 would move away from the control valve member 54. If the gap between the sealing face 55 of the control valve member 54 and the orifice 47 of the conduit 46 were too large, then the pressure in the control pressure chamber 50 would drop, and the closing piston 42 would move toward the control valve member 54.

By suitable adjustment of the control valve member 54, the opening stroke of the injection valve member 24 can be defined in infinitely graduated fashion.

Because of the pressure in the control pressure chamber 50, no force on the control valve member 54 results, because the cross-sectional area of the control valve member in the control pressure chamber 50 is equal to the cross-sectional area of the orifice 47 of the conduit 46 of the closing piston 42. The control valve member 54 is thus in force equilibrium. For a motion of the control valve member 54 that is engendered by the change in the pressure in the work chamber 72 brought about by the piezoelectric actuator 78, only a slight force acting on the control valve member 54 is accordingly necessary. Both the piezoelectric actuator 78 and the hydraulic booster can therefore be embodied with small dimensions.

By suitable triggering of the piezoelectric actuator 78 of the control valve 18 via the control unit 20, the instant of opening, the duration of opening, and the length of the opening stroke of the fuel injection valve 16 can all be determined. Thus a preinjection, for instance, can be achieved, by opening the fuel injection valve initially only briefly and/or with a short opening stroke, and then opening it for a longer time and/or with a longer opening stroke for the main injection. A certain course of the injection can also be attained, in which for instance the fuel injection valve is initially opened with only a slight opening stroke and then is opened with a longer opening stroke. Any other arbitrary course of the injection can also be attained.

What is claimed is:

1. A fuel injection valve for internal combustion engines, in particular as a component part of a reservoir-type fuel injection system, having an axially displaceably guided injection valve member (24) by which at least one injection opening (26) is controlled and which has a pressure shoulder (36) defining a pressure chamber (34), fuel under pressure being delivered to the pressure chamber (36) from a high-pressure fuel source (10; 14), by which fuel the injection valve member (24) can be lifted, counter to a closing force, from a valve seat (30) to open the at least one injection opening (26), and having a control valve (18) which varies the motion of the injection valve member (24) and has a control valve member (54) actuated by a piezoelectric actuator (78), the control valve member controlling the pressure prevailing in a control pressure chamber (50) communicating with a pressure source (10: 14), which pressure urges the injection valve member (24) at least indirectly in its closing direction, and by means of the control valve member (54) the control pressure chamber (50) can be made to communicate with a relief chamber (12), characterized in that the control valve (18) has a closing piston (42), which acts on the injection valve member (24) and defines the control pressure chamber (50); that in the closing piston (42), a conduit (46) is embodied for connecting the control pressure chamber (50) to the relief chamber (12); and that the control valve member (54) cooperates with the orifice (47) of the conduit (46) at the closing piston (42) as a valve seat for opening and closing the conduit (46), and the cross-sectional area of the control valve member (54) in the control pressure chamber (50) is at least approximately the same size as the cross-sectional area of the orifice (47) of the conduit (46).

2. The fuel injection valve of claim 1, characterized in that the control valve member (54) has a control piston (70), which defines a work chamber (72), and that the pressure in the work chamber (72) is varied by the piezoelectric actuator (78), and via the control piston (70), the control valve member (54) is pressed toward the closing piston (42) by the pressure prevailing in the work chamber (72), counter to the force of a prestressed restoring spring (76).

3. The fuel injection valve of claim 2, characterized in that a prestressed spring (64) acting counter to the restoring spring (76) engages the control valve member (54), and the prestressing of the restoring spring (76) is greater than the prestressing of the spring (64).

4. The fuel injection valve of claim 1, characterized in that the conduit (46) in the control pressure chamber (60) discharges at the face end of the closing piston (42), and that the control valve member (54) is disposed at least approximately coaxially to the closing piston (42).

5. The fuel injection valve of claim 1, characterized in that the closing piston (42) is disposed in a bore (44) of stepped diameter in a housing part (48) of the control valve (18), and the closing piston (42) is guided displaceably in a bore portion **(44*b*) of smaller diameter that defines the control pressure chamber (50), and the conduit (46) for connection with the relief chamber (12) discharged into a bore portion (44*a*)** of larger diameter.

* * * * *